US011548774B2

(12) United States Patent
Covi

(10) Patent No.: US 11,548,774 B2
(45) Date of Patent: Jan. 10, 2023

(54) CLOSING UNIT FOR A BEVERAGE CONTAINER

(71) Applicant: Emanuela Covi, Merano (IT)

(72) Inventor: Emanuela Covi, Merano (IT)

( * ) Notice: Subject to any disclaimer, the term of this patent is extended or adjusted under 35 U.S.C. 154(b) by 84 days.

(21) Appl. No.: 17/051,053

(22) PCT Filed: Apr. 29, 2019

(86) PCT No.: PCT/IT2019/050086

§ 371 (c)(1),
(2) Date: Oct. 27, 2020

(87) PCT Pub. No.: WO2019/207615

PCT Pub. Date: Oct. 31, 2019

(65) Prior Publication Data

US 2021/0122623 A1 Apr. 29, 2021

(30) Foreign Application Priority Data

Apr. 27, 2018 (IT) ..... 102018000004921
Apr. 23, 2019 (IT) ..... 102019000006272

(51) Int. Cl.
*B67D 1/08* (2006.01)
*B65D 8/02* (2006.01)
*B67D 1/00* (2006.01)

(52) U.S. Cl.
CPC ..... *B67D 1/0835* (2013.01); *B65D 11/08* (2013.01); *B67D 1/0082* (2013.01); *B67D 1/0807* (2013.01); *B67D 1/0808* (2013.01)

(58) Field of Classification Search
CPC ..... B65D 11/08; B65D 1/0835; B65D 1/0082
USPC ..... 222/400.7
See application file for complete search history.

(56) References Cited

U.S. PATENT DOCUMENTS 5,046,645 A * 9/1991 Hagan ..... B65D 83/48 222/394
6,666,358 B1 12/2003 Field
11,214,417 B2 * 1/2022 Covi ..... B65D 53/02
2004/0020947 A1 * 2/2004 Delbarre ..... B65D 11/08 222/400.7
2013/0192691 A1 * 8/2013 Smith ..... B67D 1/0808 137/320

FOREIGN PATENT DOCUMENTS

GB 2481465 A 12/2011

OTHER PUBLICATIONS

International Search Report and Written Opinion from PCT/IT2019/050086 dated Dec. 6, 2019 (13 pages).

* cited by examiner

*Primary Examiner* — Jeremy Carroll
(74) *Attorney, Agent, or Firm* — Calfee Halter & Griswold LLP

(57) ABSTRACT

A closing unit associable with a keg type container suitable to contain a beverage, and consisting of two cooperating coaxial containers, wherein the external container has anchoring means, or a threaded portion, comprising a valve assembly and a closing device, which can be stably anchored to the threaded portion and configured to reciprocally position with respect to each other the valve assembly and the containers.

17 Claims, 4 Drawing Sheets

CLOSING UNIT FOR A BEVERAGE CONTAINER

CROSS-REFERENCE TO RELATED APPLICATIONS

This application is a 371 of PCT Application No. PCT/IT2019/050086 filed on Apr. 29, 2019, which claims priority to Italian Application No. 102018000004921 filed on Apr. 27, 2018, and Italian Application No. 102019000006272 filed on Apr. 23, 2019, the contents of which are hereby incorporated by reference as if recited in their entirety.

FIELD OF THE INVENTION

The present invention concerns a closing unit suitable to close the upper part of the opening of containers, also called kegs, with two coaxial bodies, of which an external container, or drum, has a support and protection function, and an internal container, or bag, is used to contain the beverage, and is associated with dispensing devices.

The present invention concerns the closing device which serves to assemble and hold both the external and also the internal container, as well as the valve assembly, in reciprocal position.

The present invention is applied to various types of containers, both those which dispense beverages directly from the internal container, for example by compressing the external one, and also those that provide the introduction of a fluid, for example air, between the internal container and the external container.

The present invention preferentially, though not exclusively, concerns containers which allow to remove the beverages by introducing gaseous fluid between the two coaxial containers.

BACKGROUND OF THE INVENTION

Upper closing units of these types of containers are known.

It is known that the closing device, and/or the valve assembly, must be equipped to connect both with the means to introduce the beverage and also with the means to dispense the beverage present inside the internal container.

Examples of valve assemblies and closing devices are known, for example, from GB-A-2481465, U.S. Pat. No. 5,046,645 and WO-A-2018/225109.

The known systems have a plurality of disadvantages.

A first disadvantage is that the kegs cannot be recycled in a single body, but must be at least partly disassembled and some components broken down to be recycled in different ways.

This entails considerable additional labor costs, problems with separate transportation, costs for separate storage with specific designated areas and further investment and management costs and recycling costs.

A second disadvantage is the number and complexity of the components, which entail considerable sourcing, storage, assembly, installation and maintenance costs, as well as cleaning and sanitizing costs.

In addition to these, the spring of the valve assembly is normally made of steel and therefore can release components into the beverage that some people are intolerant to.

In known solutions, furthermore, there can be the danger of mold forming if beer stagnates, even in small quantities, in the valve assembly, or between the latter and the closing stopper.

One purpose of the present invention is to provide a container, with the connected closing unit, which is recyclable as a whole and therefore uses a single function to shred the whole, and also to store, transport and recycle it.

Another purpose is also to drastically reduce the components, reducing sourcing, storage, management, cleaning, assembly, and maintenance costs and costs to replace used parts.

Another purpose is also to provide a valve assembly made of plastic material which can be recycled with the remaining components of the keg, also allowing a distinct reciprocal male-female union with an equal and uniform pressure throughout the entire circumferential area.

Another purpose is to simplify the valve assembly.

Another purpose is also to improve the functioning of the operations to fill and close the container.

Another purpose is to improve the functioning of the operations to tap the beverage, obtaining a flow that is as constant and uniform as possible.

To obtain all these advantages, the invention has set itself two specific problems:

- drastically reduce the number of components;
- make all the components of recyclable plastic that belongs to the same recycling category.

Where the need arises to use a plastic which is normally not recyclable with all the remaining parts, the invention provides to produce this part of the closing unit with a total weight that is lower than the tolerated limit of incompatible components in the whole mass of recycled material of the container, or keg.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

Embodiments described here concern a closing unit associable with a keg type container suitable to contain a beverage, and consisting of two cooperating coaxial containers, of which one external container and one internal container.

The components of the closing unit are made of recyclable plastic material, possibly also in direct union with the containers.

According to a first embodiment of the invention, the axial assembly of the internal container and external container has a known form in which the upper portion of the collar of the external container has anchoring means with, advantageously, though not necessarily, a screw type closing device.

According to a further embodiment, the external collar portion of the internal container is coherently known to cooperate with the internal collar portion of the external container for the reciprocal coaxial positioning according to the three axes x, y and z.

The closing unit according to the invention comprises a valve assembly and a closing device able to be stably anchored to a portion of the external container, and reciprocally positioning the valve assembly and the two containers with respect to each other, in which the valve assembly comprises a valve body and a spring device.

The invention also provides a further embodiment according to which the internal portion of the collar of the internal container is conformed to cooperate with a lateral gasket for the circumferential seal of the valve assembly.

The invention provides that the upper end parts of the two containers are of the type suitable to cooperate with a gasket which guarantees that autonomously there can be no passage either of the beverage or of gaseous flows, for example air, between the two containers.

According to another embodiment of the invention the cooperation between the collar of the internal container and the collar of the external container generates, in one or in the other collar, suitable means to allow the gaseous fluid, which is introduced between the two coaxial containers, both to enter forcedly and also to exit unforcedly.

According to some embodiments, the internal container is provided with at least one section for air or gaseous fluid to pass in a radial direction, which puts in communication a hollow space present between the internal container and the external container with the external environment.

In this way the container, or keg, even after the removal of the dispensing devices, never remains pressurized, since the pressurized air, or gas, can flow through the through holes toward the outside.

Consequently, the container can be transported and handled safely, or even crumpled, without the risk of possible explosions.

According to a variant of the invention, in addition to keeping the two containers and the valve assembly in the respective reciprocal position, the closing device is equipped to house both the devices dispensing beverage from inside the internal container, and also to house the devices suitable to dispense the air present between the two containers.

According to a variant the closing device is also equipped for the application of means to introduce the beverage inside the internal container.

Another variant provides that in the closing device a suitable seating is present to temporarily, and on each occasion in a stable manner, house an anti-dirt lid.

The invention, in a variant thereof, also provides that the closing device can cooperate with the valve assembly to keep a female component of a mobile sealing unit of the valve assembly in the correct stable position with respect to a male component, or vice versa.

According to a first variant, the valve body includes, in itself, the seating of the female component of the mobile sealing unit of the valve assembly.

According to a further variant, the valve body includes, in itself, the male component of the mobile sealing unit and the possible slits for the transit of the beverage.

Another variant provides that the valve body has a sealing lid which is broken with the first dispensing of the beverage from the dispensing device itself, defining a passage aperture for the beverage, which can be selectively opened or closed by the mobile sealing unit.

An evolutionary variant provides that the sealing lid, detaching itself from the valve body, anchors itself on the upper part of the male component of the mobile sealing unit, present in the spring device, if the valve body includes, in itself, the female component.

In another variant, the spring device provides, in itself, a seating defining the female component of the mobile sealing unit.

According to further variants, the male component and the female component have mating truncated cone shapes.

In a further variant, the male or female component, associated with the spring device of the mobile sealing unit, has another seating, flat or conical, possibly equipped with a gasket, against which a coordinated ring presses, associated with the other female, or male component associated with the valve body.

In another variant, the valve body has one or more of either an upper sealing gasket of the containers, an internal sealing gasket of the spring device, or a lateral sealing gasket with respect to the internal collar of the internal container.

In another variant, the valve body comprises in a single body a rigid plastic material which defines its structure, and a soft plastic material stably associated with the rigid material and defining one or more gaskets.

According to some embodiments, the structure of the valve body comprises an upper annular portion, an equipped wall connected to the upper annular portion, and a lower extension extending from the equipped wall and defining a housing cavity for the spring device.

According to a variant of the valve body, the equipped wall comprises the passage aperture and the female component of the mobile sealing unit.

According to a variant, the upper annular portion is connected to the equipped wall by means of connection elements separated by transit slits through which the air can flow toward, or from, the hollow space between the two containers.

According to a variant, the upper annular portion is connected to the equipped wall by means of a connection wall provided with at least one transit slit through which the air can flow toward, or from, the hollow space between the two containers.

According to some embodiments, the transit slit is made in proximity to or in correspondence with the upper annular portion.

According to some embodiments, the valve body also comprises an abutment wall, suitable to cooperate, during use, with the internal surface of the internal container, and configured to support the possible lateral gasket.

According to some embodiments, the valve assembly has at the bottom part a support element suitable to support the spring device, and act as a contrast for it.

According to some embodiments, the support element is integral with and made in a single piece with the valve body.

According to a variant, the support body and the valve body are made as distinct elements which can be coupled and anchored to each other, with the spring device inserted and maintained in compression between them.

The support element, according to a variant, has slits for improving the cleaning and sanitizing of the component.

According to the invention, the support element has a size coherent with that of the internal spring device of the valve assembly.

According to a variant, the support element can have a diameter up to a diameter coherent with that of the abutment wall which serves to support and position the lateral gasket which cooperates with the internal collar of the internal container.

According to another variant, at least one transit channel of air or gaseous fluid is present in the segment of close reciprocal cooperation, between the external collar of the internal body and the internal collar of the external body.

The at least one channel cooperates with a transit section, present in the collar of the internal container so that the air, or the gaseous fluid, to be sent between the two containers for the tapping, or that exits in excess from the chamber present between the two containers, can exit or enter without difficulty.

According to a first solution, the spring device is associated with the male component of the mobile sealing unit.

According to a variant, the upper part of the spring device is directly conformed to itself define the male component of the mobile sealing unit.

The male component of the mobile sealing unit, in addition to being conformed in association with or in a single body with the spring device, cooperates in a coordinated manner with the spring device made of the same type of recyclable material as the other components.

The spring device, according to a first variant, is anchored in the internal part of the support element, according to a further variant it rests on a suitable base present in the support element.

The spring device is advantageously made of plastic, like the remaining components of the beverage container, and advantageously consists of two or more linear zig-zag springs.

The spring device according to a preferred solution has at least one load distribution ring and at least two linear zig-zag springs, advantageously three or more, associated with the distribution ring.

According to some embodiments, there are two distribution rings connected to each end of the linear zig-zag springs.

The linear zig-zag springs, according to one embodiment, have longitudinally conformations that follow each other, connected and opposite each other, disposed astride the longitudinal axis of the spring device.

According to one variant it has straight segments, and according to another variant arcuate segments, that is, semicircular.

The length of the linear zig-zag springs, their sizes, their thrust power, the number of useful cycles and the corresponding duration are those compatible with a duration higher than the average of these containers.

The shape of the spring device, thanks to the load distribution ring and to the linear zig-zag springs distanced equally along the circumference of the load ring guarantee a uniform thrust force along the circumference.

According to a variant of the invention, the valve body is simplified and the application of the closing device is improved, in addition to improving the seal.

Furthermore, the danger of mold formation is eliminated.

BRIEF DESCRIPTION OF THE DRAWINGS

We will now see, with the aid of the attached drawings, an example of a form of embodiment of the invention.

To facilitate comprehension, the same reference numbers have been used, where possible, to identify identical common elements in the drawings. It is understood that elements and characteristics of one embodiment can conveniently be incorporated into other embodiments without further clarifications.

DETAILED DESCRIPTION OF SOME EMBODIMENTS

Figure 1:
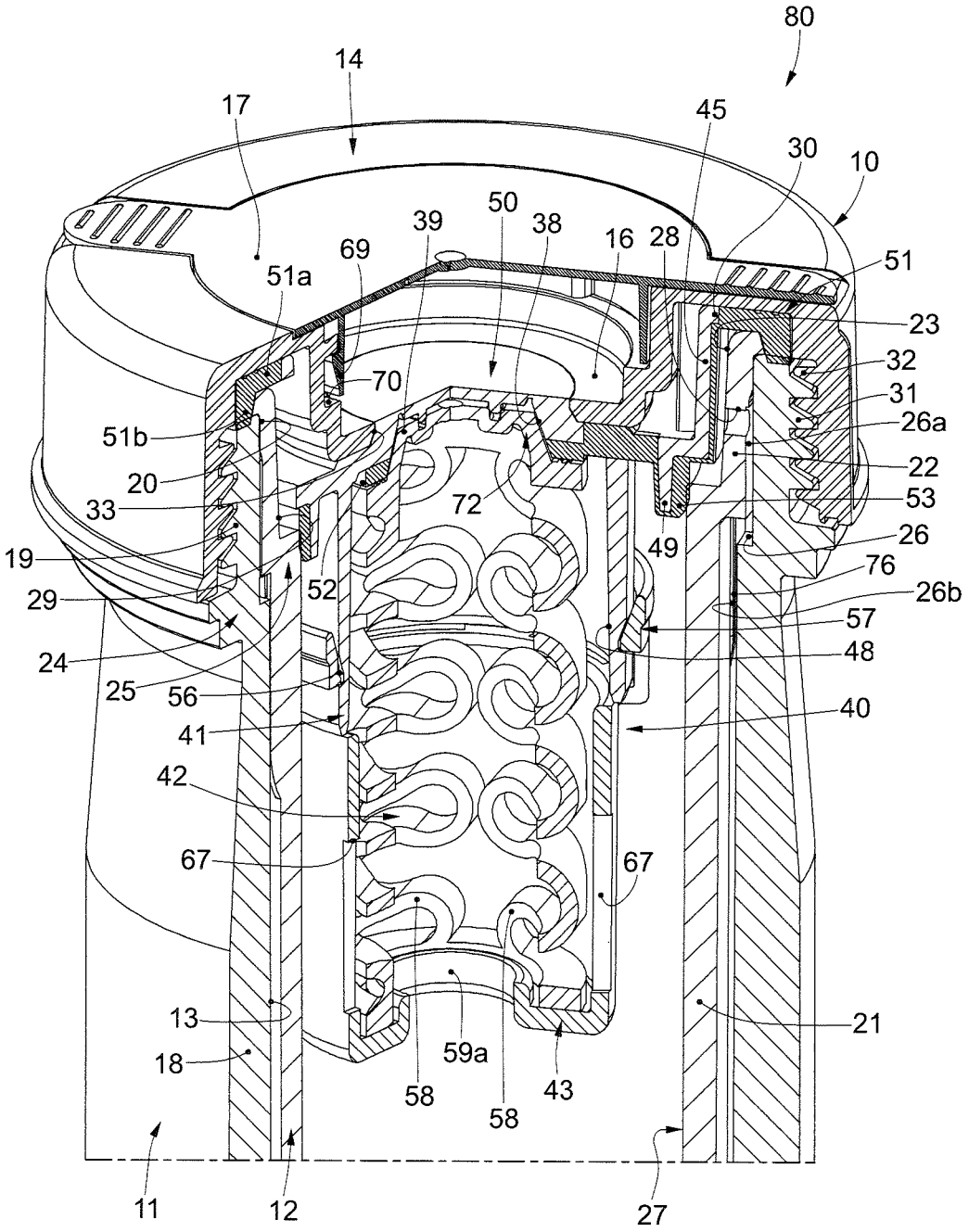
FIG. 1 shows a partially sectioned three-dimensional view of a valve assembly according to embodiments described here in a closed configuration, applied to an assembly of pre-forms suitable to form a container with two components.

We will now refer in detail to the various embodiments of the present invention, of which one or more examples are shown in the attached drawings. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Embodiments described here concern a closing unit 10 of the type associable with a beverage container 80, also referred to in the field as the drum, or keg, which can be obtained by blowing two preforms.

By way of example, the beverage contained can be beer, or another carbonated beverage, such as sparkling wine, or a non-alcoholic beverage, or even a non-carbonated beverage, such as wine or other for example.

The container 80 comprises an external container 11 and an internal container 12, disposed inside the external container 11 and axial to the latter, wherein there is a hollow space 13 between the internal container 12 and the external container 11.

The internal container 12 and the external container 11 are reciprocally positioned in a known manner through the reciprocal collars, or collar portions 19, 22.

The closing unit 10 according to the invention comprises a valve assembly 40 and a closing device 14 configured to guarantee both the correct and stable reciprocal positioning of the valve assembly 40 and the container 80, and also the hermetic seal of the latter.

According to some embodiments, the closing device 14 comprises a seating 15 for an anti-dirt lid 17, which can be removed at the time of use to allow access to the valve assembly 40 and the installation of suitable dispensing devices, not shown. These dispensing devices, during use, allow to introduce a pressurized fluid into the hollow space 13, so as to compress the internal container 12 and thus cause the exit of the beverage.

The external container 11 comprises a containing portion 18 and the collar portion 19 provided with a first aperture 20.

The internal container 12 comprises a containing portion 21 and the collar portion 22 provided with a second aperture 23 disposed inside the respective containing portion 18, collar portion 19 and first aperture 22 of the external container 11.

The containing portion 21 defines, during use, a containing compartment 27 for the beverage.

According to some embodiments, the external container 11 and the internal container 12 have respective step-like portions 24, 25 in the respective transition zones between the containing portion 18, 21 and the corresponding collar portion 19, 22, offset with respect to each other, so as to guarantee the presence of the hollow space 13 between the containers 11, 12 even after blowing.

The step-like portions 24, 25 respectively define a distribution channel 26 in which a pressurized fluid can flow and a housing recess 29 suitable to cooperate with the valve assembly 40.

According to some embodiments, the internal container 12 has, in correspondence with the collar portion 22, at least one passage section 28 through which air or pressurized gas can flow from, or toward, the hollow space 13.

According to some embodiments, the passage section 28 is defined by one or more through holes 28.

According to a variant, the passage section 28 is defined by a slit that extends as far as the upper edge of the internal container 12.

According to some embodiments, the internal container 12 also comprises a circumferential support tooth 30 suitable to advantageously rest, during use, on the upper edge of the external container 11, defining a reciprocal axial positioning of the two containers 11, 12.

The external container 11, in this case, has externally a threaded circumferential area 31 into which a threaded portion 32 of the closing device 14 can be screwed and anchored, which holds in reciprocal position the two containers, 11 and 12 and the valve assembly 40.

The closing device 14, according to a variant, has at the upper part and in a known manner, a structure to position the dispensing means and devices necessary to tap the beverage from the internal container 12, possibly overcoming the resistance of a mobile sealing unit 50 of the valve assembly 40 and allowing the passage of the beverage through it.

The closing device 14 is equipped at the upper part and/or inside the seating 15 to stably and without leakages anchor the beverage dispensing device.

According to some embodiments, the seating has an internal annular extension 16 which acts as a base, provided with a central aperture 33 suitable to allow, during use, the transit of the beverage to be dispensed.

According to some embodiments, the seating 15 can be shaped in steps, suitable to define positioning and abutment references for the dispensing devices.

The valve assembly 40, according to some embodiments of the invention, is made in such a way as to allow a suitable dispensing device to introduce pressurized gas, such as air, into the hollow space 13, which by acting between the two containers 11, 12, the internal container 12 being substantially compressible, serves to extract the beverage, and at the same time provide a passage aperture 34 through which the beverage in the internal container 12 can pass in order to reach the dispensing devices.

The valve assembly 40 according to the invention comprises a valve body 41, a spring device 42 and, in the example, a support element 43, suitable to axially position the spring device 42.

The valve body 41 comprises a rigid structural body 41*a* and a soft material 41*b* associated stably with the rigid structural body and defining one or more sealing gaskets 51, 52, 53.

According to some embodiments, the rigid structural body 41*a* comprises an upper annular portion 35, an intermediate equipped wall 36, or plate, and a lower extension 37.

The lower extension 37, during use, is coaxial with the containers 11, 12.

The upper annular portion 35 is connected to the equipped wall 36 by means of one or more connection elements 45.

According to embodiments described with reference to FIGS. 1-3, a plurality of connection elements 45*a* can be provided separated by transit slits 46 which define passage channels for the gas, that is, for carbon dioxide.

According to these embodiments, the connection elements 45 can be distanced equally along the circumference of the upper annular portion 35 and of the equipped wall 36.

The connection elements 45 can have ribs or ridges 47 necessary for the connection with the dispensing device.

According to some embodiments, the passage aperture 34 is provided, during use, in the equipped wall 36.

According to some embodiments, the lower extension 37 is defined by a tubular-shaped wall which extends from the lower surface of the equipped wall 36 and defines a housing cavity 48 suitable to house at least part of the spring device 42.

The lower extension 37 has a size that is coherent with the requirements of the spring device 42.

According to further embodiments, the valve body 41 comprises an abutment wall 49 with an annular shape which extends from the lower surface of the equipped wall 36, and suitable to cooperate, during use, with the internal surface of the internal container 12.

According to some embodiments, the abutment wall 49 is external and coaxial to the lower extension 37.

An annular cavity 55 can be present between the lower extension 37 and the abutment wall 49.

According to the variant described with reference to FIGS. 6 and 7, a solution is described which, as well as simplifying the valve body 141, allows to eliminate any danger of beer stagnating and therefore the formation of mold.

In addition to this, the valve assembly is improved, simplifying it, and the hydraulic seal is improved.

The application of the beverage dispensing device is also improved.

The valve body 141 according to the variant shown in FIGS. 6 and 7 also comprises in a single body a rigid plastic material which defines its structure 35, 36, 37, 47 and a flexible plastic material stably associated with the rigid material and defining a plurality of gaskets 51, 52, 53.

In the valve body 141 the upper annular portion 35 is connected to the equipped wall 36 by means of a connection element 45 in the form of a substantially continuous annular wall 45*b*. In this embodiment, the transit slits 46 are eliminated.

Furthermore, according to some embodiments the connection wall 45*b* is provided with ribs or ridges 47 which extend toward the inside, which on one side can allow the connection with the dispensing device, and on the other side define in pairs a vent channel 83 for the gas.

According to some embodiments, to allow the transit of carbon dioxide toward the hollow space 13, the valve body 141 comprises at least one passage channel for the gas 81 which puts an internal side in communication with an external side of the valve body 141.

According to embodiments described with reference to FIG. 6, the passage channel 81 is defined by a vent hole 81*a* made in the connection wall 45*b* in proximity with the upper annular portion 35. According to other embodiments, one or more vent holes 81*a* distanced from each other can be present.

Figure 5:
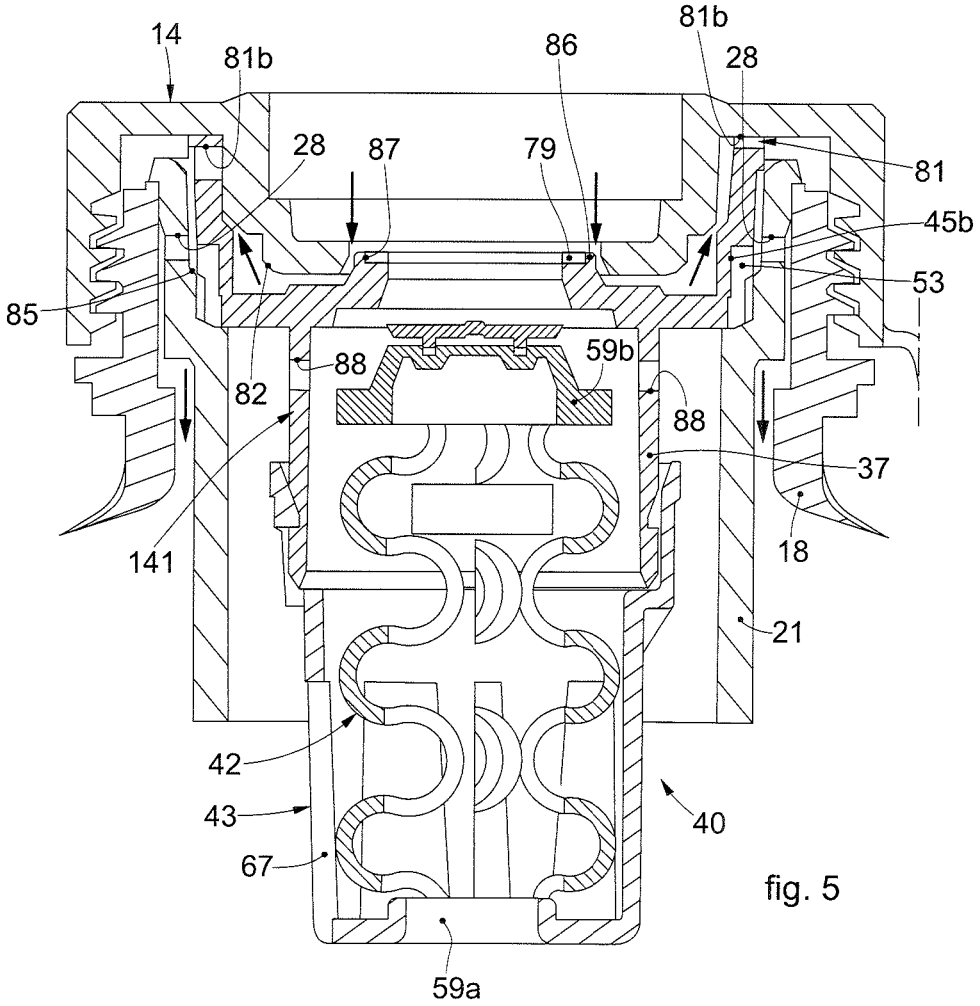
FIG. 5 shows a sectioned front view of the part of FIG. 6 during tapping operations.

According to other embodiments, described with reference to FIG. 5, the passage channel 81 can be defined by at least one groove 81*b* made in the upper annular portion 35, which extends radially with respect to a longitudinal axis of the valve body 141.

According to other embodiments, one or more holes 81*a* and/or one or more grooves 81*b* can be present.

Providing the hole 81*a* and/or the grooves 81*b* in correspondence with an upper portion of the valve body 141 is advantageous to stop the beverage leaking through them, when the container 80 filled with the beverage is closed. In this way the risk of possible stagnations of beverage, which could otherwise accumulate in a compartment 82 between the closing device 14 and the equipped wall 36 and generate mold, is reduced, if not eliminated.

According to further embodiments, the valve body 141 comprises one or more radial hollows 84 made in the thickness of the equipped wall 36, suitable to channel, during use, the gas injected into the valve body 141 to make it pass from the compartment 82 toward the passage channel or channels 81.

Furthermore, the lower abutment wall 49 has been eliminated in the valve body 141, improving the seal of the lateral gasket 53 which, in this case, extends substantially over the entire lower circumferential portion of the connection wall 45*b*.

During use, the closing device 14 is positioned in a stable manner with a lower circumferential portion 80 thereof on an annular positioning edge 85 provided on the connection wall 45*b*.

The annular edge 85 defines a step in the connection wall 45*b*, reducing its internal diameter.

According to some embodiments, there is a sealing gasket 79 around the central portion of the equipped wall 36 which defines the sealing lid 44, configured to isolate, during use, the carbon dioxide circuit from the beverage circuit, improving the seal of the valve body 141.

According to further embodiments, the equipped wall 36 can comprise a protruding annular ridge 86 which surrounds the central portion defining the sealing lid 44 and the sealing gasket 79 which defines, together with the base portion 80 of the closing lid 14, a passage gap 87 for the gas toward the compartment 82.

Thanks to this modification, during the closing of the container 80 with the closing device 14, carbon dioxide ($CO_2$) can be injected into the valve body 141 inserted in the internal container 12, making it pass through the passage gap 87 and through the radial hollows 84 and vent channels 83, as far as the passage channel/channels 81, substantially cleaning the compartment 82 from possible beverage residues.

Furthermore, the injected carbon dioxide passing through the passage channels 81 can reach the inside of the container 80, filling the head space above the beverage.

According to further embodiments, the valve body 41, 141 also comprises one or more transit holes 88 made through in the lower extension 37 in proximity to the zone where the lower extension 37 and the equipped wall 36 connect.

Thanks to these transit holes 88, when a dispensing device is inserted in cooperation with the valve device 40, it is possible to very quickly remove the carbon dioxide present in the head space.

Furthermore, these transit holes 88 also facilitate the exit of the beverage when the internal container 12 is almost completely collapsed, allowing to tap substantially the entire quantity of beverage present therein.

According to some embodiments, the body of soft material 41*b* comprises one or more of either an upper gasket 51, a lateral gasket 52, or an internal gasket 53.

According to some embodiments, the upper gasket 51 is associated with the upper annular portion 35.

According to possible solutions, the upper gasket 51 has an L-shaped section, with a first segment 51*a* which develops in a radial direction from the upper annular portion 35, and a second segment 51*b* which develops transversely to the first segment 51*a* facing toward the equipped wall 36.

The upper gasket 51 seals the upper edges of the containers 11, 12 together and toward the outside, and is suitable to cooperate with the first segment 51*a* with the upper edge of the internal container 12, and with the second segment 51*b* with the upper edge of the external container 11.

According to further embodiments, there is an internal gasket 52, suitable to act as a seal for the mobile sealing unit 50.

According to some embodiments, the internal gasket 52 has an annular shape and is associated with the equipped wall 36 around the passage aperture 34 defined by the female component 38.

According to some embodiments, during use, the internal gasket 52 is interposed between the equipped wall 36 of the valve body 41 and the spring device 42.

According to further embodiments, a lateral gasket 53 is provided, suitable to act as a seal between the valve body 41, 141 and the internal container 12 and configured to cooperate with the surface of the containing compartment 27 of the internal container 12.

According to possible solutions, the lateral gasket 53 is associated with the abutment wall 49 and extends over the entire external circumference of the latter so that, during use, it is circumferentially in contact with the internal surface of the internal container 12.

In this way, any leakage of the beverage between the valve body 41, 141 and the internal container 12 is prevented, guaranteeing that the beverage is dispensed only through the passage aperture 34 when it is in the open condition.

According to some embodiments, the valve assembly 40 comprises a mobile sealing unit 50 configured to selectively open and close the passage aperture 34.

According to some embodiments, the mobile sealing unit 50 comprises a female component 38 and a male component 39 at least partially mating in shape and configured to couple with each other to selectively close the passage aperture 34.

According to some embodiments, the equipped wall 36 of the valve body 41, 141 includes the seating, that is, the female component 38, of the mobile sealing unit 50.

According to some embodiments, the male component 39 can be provided on the spring device 42.

In the case shown by way of example, in the initial step, the female component 38 of the mobile sealing unit 50 is closed by a sealing lid 44 which has a predefined breaking line 71.

According to some embodiments, the sealing lid 44 is defined by a central portion of the equipped wall 36 with a smaller thickness, configured to be separated from the equipped wall 36 at the first introduction of a beverage dispensing device, so as to define the passage aperture 34 of the valve assembly 40 through which the beverage to be dispensed can pass.

According to some embodiments, the central portion defining the sealing lid 44 is protruding with respect to an upper surface of the equipped wall 36, and recessed with respect to a lower surface, so as to define the female component 38.

According to further embodiments, the valve body 41 comprises a support ring 54 suitable to cooperate, during use, with the housing recess 29 of the internal container 12 and to rest on the step-like portion 25 of the latter, guaranteeing a correct and precise axial positioning of the two components.

According to some embodiments, the support ring 54 is defined by an end portion of the equipped wall 36 protruding beyond the abutment wall 49.

Figure 2:
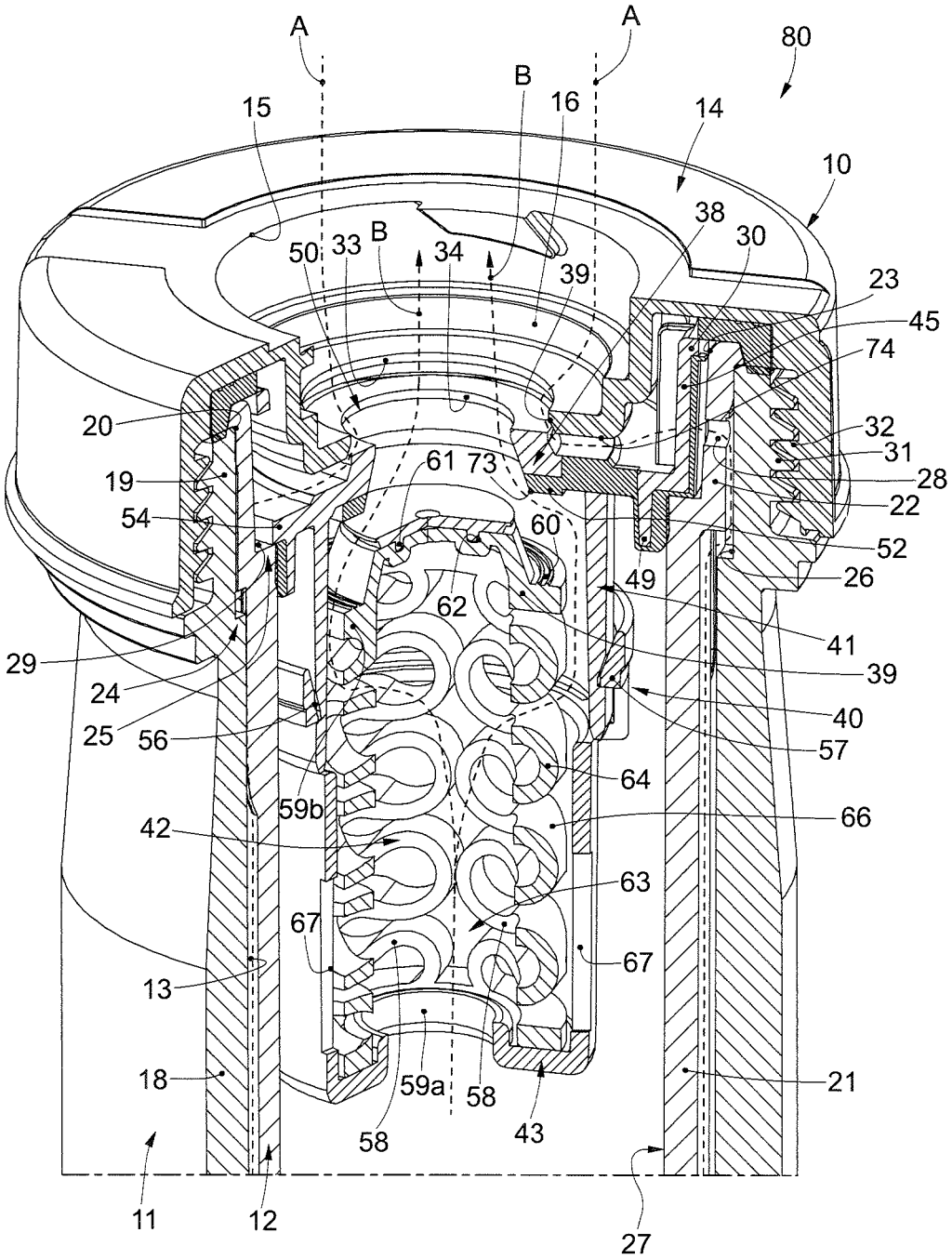
FIG. 2 shows a partially sectioned three-dimensional view of the valve assembly of FIG. 1 in operating mode, after the insertion of a dispensing device.
Figure 3:
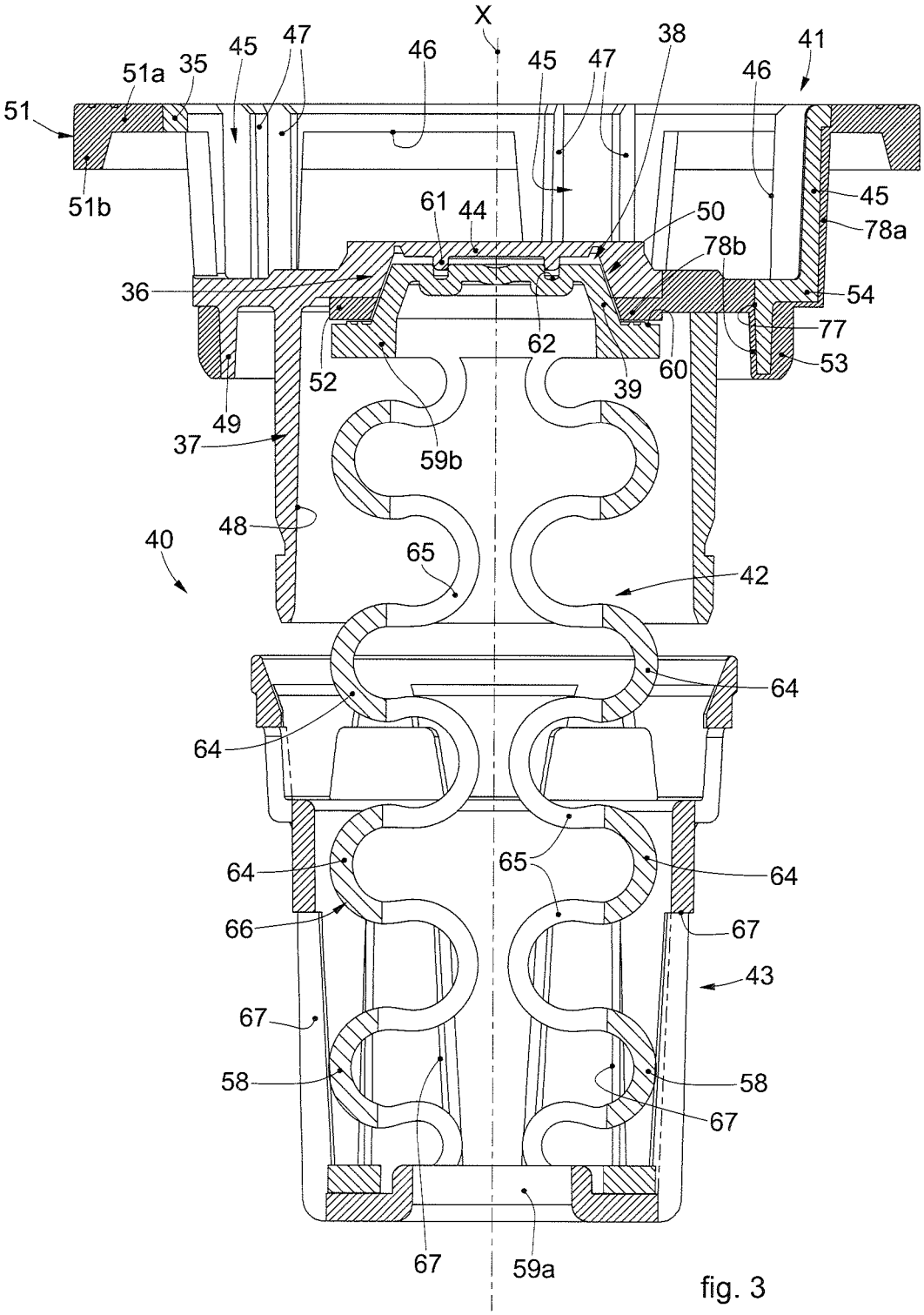
FIG. 3 shows a sectioned front view of a valve assembly according to a variant embodiment.

With reference to FIGS. 1 and 2, the sealing lid 44 has an annular protrusion 61 suitable to be inserted into and coupled with an annular hollow 62 present on the male component 39 of the mobile sealing unit 50, and this attachment occurs when a dispensing device is introduced for the first time.

In this way, when the dispensing device presses the sealing lid 44 and separates it from the equipped wall 36, it anchors itself to the spring device 42, becoming part of the male component 39.

When the dispensing device is removed, the elastic compression force of the spring device 42 will tend to extend the latter, bringing the male component 39 and therefore the sealing lid 44 connected thereto to couple with the female component 38 and the equipped wall 36 so as to close the passage aperture 34.

According to some embodiments, the valve body 41, 141 can be made by injection over-molding of the soft material onto the rigid material.

According to some embodiments, the gaskets 51, 52, 53 have connecting flaps 78*a*, 78*b* which join them one to the other, all being obtained with a single injection point.

According to these embodiments, the equipped wall 36 made with the rigid material can be provided with a passage slit 77 suitable to allow the soft material to pass through it, in order to make the internal gasket 52.

According to variant embodiments, the gaskets 51, 52, 53 are separated from one another. In this case, it can be provided that they are made independently of one another, for example by means of injection over-molding on the respective parts of the valve body 41, 141 with which they are associated.

According to this embodiment, the passage slit 77 is therefore filled with the soft material.

According to some embodiments, the spring device 42 in this specific case has in a single body one or more springs 58 and at least one distribution ring 59*a*, 59*b*.

According to some embodiments, for example described with reference to FIG. 3, the spring device 42 comprises a lower distribution ring 59*a* and an upper distribution ring 59*b*.

The upper distribution ring 59*b*, in this specific case, has an annular ledge 60 from which, by way of example, the male component 39 of the mobile sealing unit 50, associated with the spring device 42, originates.

Figure 4:
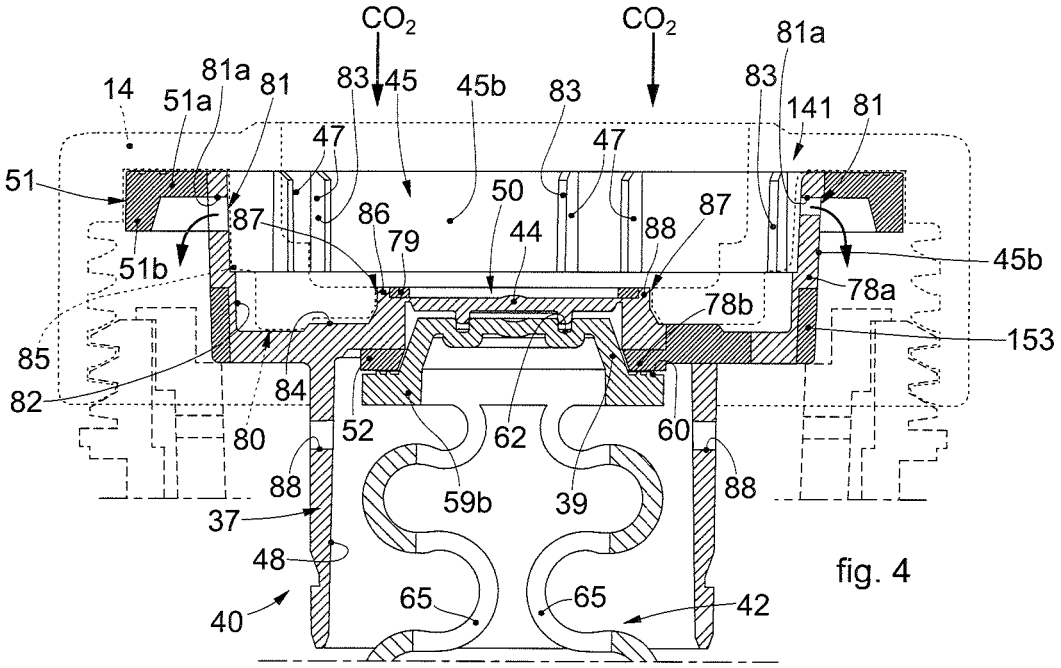
FIG. 4 shows a sectioned front view of a part of the valve assembly according to another variant embodiment.

The springs 58 can be helicoidal 58*a*, FIG. 4, or linear zig-zag-shaped 58*b*, FIGS. 1-2, having a conformation suitable to generate the desired thrust for the necessary time.

It should be noted that the helicoidal springs 58*b*, due to their conformation, do not exert a uniform pressure on the support circumference of the spring device 42, between the male component 39 and the female component 38, but are affected by the position where the helix ends.

To overcome this disadvantage, according to a variant of the invention, linear zig-zag springs 58*b* are used in a number and conformations suitable to generate the desired thrust, guaranteeing the necessary axial travel of the male component 39 of the spring device 42.

According to some embodiments, the zig-zag spring elements 58*a* are connected to both the distribution rings 59*a*, 59*b* in correspondence with their ends.

According to some embodiments, the zig-zag spring elements 58*a* are independent of each other, that is to say they are not directly connected to one another but only to the distribution rings 59*a*, 59*b*. This allows to obtain a better load distribution and greater seal and duration of the spring device 42.

According to some embodiments, the zones connecting the zigzag springs 58*a* and the distribution rings 59*a* 59*b* are substantially aligned with each other along the respective circumferences of the lower 59*a* and upper 59*b* distribution ring, that is, overlapping along respective vertical axes.

According to some embodiments, the distribution rings 59*a* and 59*b* lie on respective planes parallel to each other and orthogonal to the longitudinal axis X.

According to some embodiments, the spring device 42 comprises an upper portion 72 suitable to act as a shutter element for a valve assembly 24.

According to some embodiments, the upper portion 72 has a truncated cone shape, and defines the male component 39 of the mobile sealing unit 50.

According to some embodiments, the upper portion 72 is associated with the upper distribution ring 59*b*.

According to some embodiments, the upper distribution ring 59*b*, on the surface facing, during use, toward the outside, has at least one rib 75 which develops circumferentially.

According to some embodiments, two or more circumferential ribs 75 can be provided, possibly concentric to each other.

According to some embodiments, the ribs 75 can cooperate with the internal gasket 52 of the valve body 41, 141 in order to guarantee a sealed coupling of the two components.

The spring device 42 is in particular sized so as to maintain a thrust approximate to a minimum value permitted during the maximum time expected to be necessary for storage, transport, storage in the user's warehouse and tapping.

According to some embodiments, the zig-zag springs 58*a* can be conformed with different geometries, so that it is possible to have undulations, linear zig-zag shapes, arcuate zig-zag shapes, consecutive waves with positive and/or negative developments, or a combination thereof.

According to possible solutions, for example shown in FIGS. 1 and 2, the spring device 42 has a circular section, that is, it comes within a cylinder with a diameter between 25 and 35 mm, advantageously around 30 mm, but it can also have other compatible sizes according to the application of the spring device 42.

According to some embodiments, the zig-zag springs 58*a* that define the spring device 42 are advantageously conformed so as to remain inside a cylindrical ring, the sizes of which are defined by the lower 59*a* and upper 59*b* distribution rings.

According to these embodiments, the spring device 42 comprises an internal compartment 63 substantially cylindrical in shape through which, during use, the beverage to be dispensed can pass.

According to some embodiments, the zig-zag springs 58*a* can have a constant thickness along their longitudinal development.

According to some embodiments, the zig-zag springs 58*a* have a profile with a plurality of crests 64 and troughs 65, defining respective alternating convexities and concavities, located in succession one after the other.

According to some embodiments, the crests 64 and the troughs 65 extend on the two sides with respect to a longitudinal center line of the zig-zag springs 58*a*.

According to some embodiments, the zig-zag springs 58*a* have a wave-shaped conformation defined by consecutive circumferences, that is, the crests 64 and the troughs 65 are defined by substantially circular-shaped portions located in succession one after the other.

According to some embodiments, there are four zigzag springs 58*a* that make up the spring device 42, opposite each other two by two.

According to these embodiments, the zig-zag springs 58*a* are connected in pairs in correspondence with the respective adjacent crests 64 by means of external connection bridges 66 which also fulfill the condition of single external wave.

According to embodiments that provide the valve assembly 40 consisting of three components, the valve body 41, 141 and the support element 43 can be coupled together, with the spring device 42 disposed between them, by means of mating coupling members 56, 57.

According to some embodiments, the coupling members 56, 57 can comprise, for example, a female annular hollow 56 provided on the valve body 41, 141 and a male annular attachment 57 provided on the support element 43, or vice versa.

According to some embodiments, the circumferential sizes of the support element 43 and of the lower extension 37 of the valve body 41 are coherent with the circumferential bulk of the spring device 42.

According to further embodiments, the valve body 41, 141 and/or the support element 43 advantageously have transit slits 46, 67 able to let disinfectant cleaning factors enter.

According to some embodiments, the transit slits 67 can be made in a longitudinal direction in the lateral wall of the support element 43, so as to make the internal surface of the support element 43 accessible, and allow it to be cleaned and sanitized, for example by means of UV rays, infrared rays, washing fluids, or other.

Depending on which variant is considered, the spring device 42 will rest on the bottom of the support element 43, or it will be anchored circumferentially, or otherwise, in an attachment element of the valve body 41.

At least one axial channel 26*b* can be present between the external part of the internal container 12 and the internal part of the external container 11, which opens into a distribution channel 26 which continues with a first transit channel 26*b*. The first transit channel 26*b* cooperates with the at least one passage section 28, in this case, substantially orthogonal to the axis of the internal container 12.

Therefore, the possible excess gaseous fluid present between the external container 11 and the internal body 12, once the beverage dispensing device has been extracted, flows freely through these channels toward the external environment.

The functioning of the closing unit 10 according to the invention is described below.

Initially the valve assembly 40 is inserted in the internal container 12 of a container 80, or keg, with two components, in assembled form, that is, with the spring device 42 integrally coupled to the valve body 41 and to the possible support element 43.

In particular, the valve assembly 40 is inserted in such a way that the upper gasket 51 is located in contact with the respective upper edges both of the internal container 12 and also the external container 11, guaranteeing at the upper part the hermetic seal of the hollow space 13 and guaranteeing the reciprocal coupling of the containers 11, 12.

In the initial insertion position (FIG. 1), the valve body 41, 141 positions itself with its support ring 54 suspended with respect to the housing recess 29 of the internal container 12, therefore the lateral gasket 53 is in contact with the internal surface of the internal container 12 only with a lower portion thereof.

Subsequently, the closing device 14 with the anti-dirt lid 17 is screwed onto the threaded circumferential area 31 of the external container 11, stably positioning the valve assembly 40, acting on the upper seal 53 of the valve body 41.

The internal annular extension 16 of the closing device 14 therefore rests on the upper surface of the equipped wall 36 of the valve body 41, 141, and stably positions the female component 38, which can therefore couple correctly with the male component 39 forming the mobile sealing unit 50.

In this case, the valve body 41 has the internal gasket 52 around the female component 38, which, when the valve assembly 40 is in the closed position, cooperates with the upper distribution ring 59*a* of the spring device 42 to guarantee the hermetic seal of the passage aperture 34 preventing the beverage from exiting.

Therefore, the valve assembly 40 has a double seal, both a mechanical seal 38-39 of the mobile sealing unit 50, and also a flexible seal provided by the internal gasket 52.

The valve assembly 40 and the closing device 14 are preferably associated with the container 80 after it has first been filled with the beverage.

Embodiments described here also concern a method to fill and close a container 80 for beverages comprising an external container 11 and an internal container 12 which provides to:

- fill the internal container 12 with the beverage;
- position the valve assembly 40 already assembled in the external container 11 with the valve body 41, 141 located in contact at the upper part with an upper edge of the external container 11;
- apply the closing device 14 over the valve assembly 40 and screw it onto the external container 11.

According to some embodiments, the method provides to inject a flow of pressurized carbon dioxide toward an upper surface of the container 80 during the positioning of the valve assembly 40, and to apply and screw the closing device 14.

According to some embodiments, the method provides in particular to start injecting a flow of pressurized carbon dioxide toward the container 80 as soon as the step of filling with the beverage has ended, and to stop injecting only when the closing device 14 has been completely screwed on the external container 11.

The flow of carbon dioxide, following the path described above, and indicated with the arrows in FIG. 6, can therefore remove possible beverage residues from the compartment 82, which could otherwise generate mold.

According to some embodiments, in the step of screwing the closing device 14 the method provides to apply a torque comprised between 45N and 55N.

By applying a beverage dispensing device for the first time in the specific seating 15 present in the closing device 14, the sealing lid 44 is pushed downward, breaking a predefined breaking line 71, in this case circumferential.

When the predefined breaking line 71 breaks, the sealing lid 44 is pushed toward the upper portion 72 of the spring device 42, compressing the springs 58*a*, 58*b* and moving the upper portion away from the equipped wall 36, so as to open the passage aperture 34.

The displacement of the sealing lid 44 and the compression of the spring device 42 entails the generation of a dispensing channel 73 through which the beverage can be dispensed.

The annular protrusion 61 of the sealing lid 44 then positions itself in the annular hollow 62 present in the upper portion 72 of the spring device 42, creating a whole 44-72, which, together with the female component 38 provided in the equipped wall 36, forms the mobile sealing unit 50.

According to some embodiments, the action of the dispensing device causes the valve body 41, 141 to be pushed downward, until the support ring 54 abuts against the step-like portion 25, and is inserted into the housing recess 29 and the lateral gasket 53 comes into full contact with the internal surface of the internal container 12.

According to this embodiment, the upper annular portion 35 separates from the upper gasket 51, which remains compressed between the closing device 14 and the upper edges of the two containers 11, 12, guaranteeing their hermetic seal.

The downward movement of the valve body 41, 141 causes a passage channel 74 to be defined between the internal annular extension 16 of the closing device 14 and the equipped wall 36, through which a pressurized fluid, for example air, introduced by the dispensing devices, can flow.

The pressurized fluid enters the passage channel 74 and transits through the transit slits 46 of the valve body 41, 141 and the passage sections 28 provided on the internal container 12 to reach the hollow space 13 and compress the internal container 12. By way of example, the arrows A in FIG. 2 indicate the path of the pressurized fluid.

The beverage then transits through the internal compartment 63 of the spring device 42, and through the springs 58*a*, 58*b* to reach the housing cavity 48 of the valve body 41, 141 and from there it passes through the dispensing channel 74 and the passage aperture 34 to reach the dispensing device. By way of example, the arrows B in FIG. 2 indicate the path of the beverage.

When the dispensing device is removed, the spring device 42, no longer subjected to compression, expands, bringing the male component 39 to couple with the female component 38 of the mobile sealing unit 50, and the sealing lid 44 substantially returns to its initial position, closing the passage aperture 34.

The valve assembly 40, therefore, is driven to close by the spring device 42 which operates axially and inside the lower extension 37 of the valve body 41 and possibly of the support element 43.

The excess air or gas, present in the hollow space 13 between the two containers 11, 12, transits through the annular distribution channel 26 to reach the passage sections 28 and from there, through the transit slits 46 and passage channel 74, it is discharged to the outside.

It is clear that modifications and/or additions of parts may be made to the closing unit 10 as described heretofore, without departing from the field and scope of the present invention.

It is also clear that, although the present invention has been described with reference to some specific examples, a person of skill in the art shall certainly be able to achieve many other equivalent forms of closing unit 10, having the characteristics as set forth in the claims and hence all coming within the field of protection defined thereby.

The invention claimed is:

1. Closing unit associable with a keg type container suitable to contain a beverage, and the keg type container consisting of two cooperating coaxial containers, wherein one external container has anchoring means, or a threaded portion, said closing unit being suitable to cooperate, also stably, with a beverage dispensing unit, the components of the closing unit are made of recyclable plastic material, possibly also in direct union with the containers, said closing unit having in reciprocal cooperation:

a valve assembly;

and a closing device, able to be stably anchored to said threaded portion and reciprocally positioning with respect to each other said valve assembly and said two containers, internal and external; wherein said valve assembly comprises:

a mobile sealing unit comprising a female sealing component cooperating with a male sealing component;

a valve body provided with a component of the mobile sealing unit;

a spring device provided with the other component of the mobile sealing unit, at least one of the following gaskets being present in said valve assembly: a lateral gasket associated with the valve body, an internal gasket associable, during use, with an internal surface of said internal container, an upper gasket, associable, during use, with the upper part of said two containers.

2. Closing unit as in claim 1, wherein said closing device comprises a seating at the upper part, suitable for the temporal positioning of an anti-dirt lid.

3. Closing unit as in claim 1, wherein a circumferential ring of said closing device cooperates with the female component of the mobile sealing unit associated with said valve body, for its stable positioning.

4. Closing unit as in claim 1, wherein said female component of the mobile sealing unit has a sealing lid that temporally closes a passage aperture of the beverage.

5. Closing unit as in claim 1, wherein said valve body comprises an upper annular portion, an equipped wall connected to the upper annular portion by at least one connection element, and a lower extension defining a housing cavity for said spring device.

6. Closing unit as in claim 5, wherein said at least one connection element comprises at least one passage slit or passage channel for a gas.

7. Closing unit as in claim 5, wherein said valve body comprises one or more radial hollows made in the thickness of the equipped wall.

8. Closing unit as in claim 4, wherein there is a sealing gasket around the central portion of an equipped wall which defines the sealing lid.

9. Closing unit as in claim 1, wherein said valve body has the female component of the mobile sealing unit conical and associated with an equipped wall cooperating with said lateral gasket.

10. Closing unit as in claim 1, wherein said valve body has a lower extension coherent with the sizes of said spring device.

11. Closing unit as in claim 1, wherein said valve body comprises within it a rigid structural body and said gaskets.

12. Closing unit as in claim 1, wherein the components are made of recyclable material.

13. Closing unit as in claim 1, wherein the gaskets are made of non-recyclable material.

14. Closing unit as in claim 1, wherein said spring device comprises at least one distribution ring and at least two linearly elastic elements or linear springs associated with said distribution ring.

15. Closing unit as in claim 1, wherein said valve assembly comprises a support element associable with said valve body, the support element positions and contrasts said spring device, said closing unit consists overall of four components: closing device, valve body, spring device and support element.

16. Closing unit as in claim 15, wherein said support element comprises passage slits made along a longitudinal direction in the lateral wall thereof, and configured to allow the access to the internal surface of said support element to allow it to be cleaned and disinfected by means of UV-rays, infrared rays, washing fluids, or other.

17. Container for beverages comprising an external container, an internal container and a closing unit as in claim 1.

* * * * *